US009998829B2

(12) United States Patent
Asfaw

(10) Patent No.: US 9,998,829 B2
(45) Date of Patent: Jun. 12, 2018

(54) BONE CONDUCTION TRANSDUCER WITH INCREASED LOW FREQUENCY PERFORMANCE

(71) Applicant: Google LLC, Mountain View, CA (US)

(72) Inventor: Michael Asfaw, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days. days.

(21) Appl. No.: 15/193,742

(22) Filed: Jun. 27, 2016

(65) Prior Publication Data

US 2017/0374470 A1 Dec. 28, 2017

(51) Int. Cl.

| | |
|---|---|
| ***H04R 1/00*** | (2006.01) |
| ***H04R 9/02*** | (2006.01) |
| ***H04R 9/06*** | (2006.01) |

(52) U.S. Cl.

CPC ..... *H04R 9/025* (2013.01); *H04R 9/06* (2013.01); *H04R 2307/204* (2013.01); *H04R 2460/13* (2013.01)

(58) Field of Classification Search

CPC ..... H04R 11/02; H04R 2400/07

See application file for complete search history.

(56) References Cited

U.S. PATENT DOCUMENTS 2,000,165 A * 5/1935 Erickson ..... H04R 11/00 381/151
2,459,325 A * 1/1949 Knowles ..... H04R 1/1075 381/151
2,500,541 A * 3/1950 Greibach ..... H04R 11/02 381/151
4,550,428 A * 10/1985 Yanagishima ..... H04R 9/04 381/407
5,624,376 A * 4/1997 Ball ..... H04R 11/02 600/25
5,894,263 A * 4/1999 Shimakawa ..... G08B 6/00 340/384.1

(Continued)

FOREIGN PATENT DOCUMENTS

WO 2008123667 A1 10/2008

OTHER PUBLICATIONS

International Search Report of International Application No. PCT/US2017/033800 dated Aug. 18, 2017.

(Continued)

*Primary Examiner* — Matthew Eason
*Assistant Examiner* — Ryan Robinson
(74) *Attorney, Agent, or Firm* — McDonnell Boehnen Hulbert & Bergfhoff LLP

(57) ABSTRACT

A bone conduction transducer includes a yoke having a pair of arms, a layer of high permeability steel on a surface of the yoke between the arms, a metal coil, a metallic post that extends into a center portion of the metal coil, a diaphragm, an anvil attached to a surface of the diaphragm, a pair of permanent magnets attached to an opposite surface of the diaphragm, and a pair of springs. A first end of each spring is attached to a respective one of the arms of the yoke, and a second end of each spring is coupled to the diaphragm. The diaphragm is configured to vibrate in response to a signal supplied to the metal coil. The diaphragm, anvil, and/or metallic post could be formed from a high permeability steel.

18 Claims, 10 Drawing Sheets

CROSS SECTION VIEW

(56) References Cited

U.S. PATENT DOCUMENTS

| | | | | |
|---|---|---|---|---|
| 6,850,138 | B1 * | 2/2005 | Sakai | H04R 9/025 335/222 |
| 8,965,012 | B1 * | 2/2015 | Dong | H04R 1/028 381/151 |
| 8,989,410 | B2 * | 3/2015 | Hebenstreit | H04R 1/00 381/151 |
| 9,462,365 | B1 * | 10/2016 | Dong | H04R 11/00 |
| 9,532,123 | B2 * | 12/2016 | Fukuda | B06B 1/045 |
| 2002/0039427 | A1 | 4/2002 | Whitwell et al. | |
| 2006/0115724 | A1 | 6/2006 | Buckle et al. | |
| 2006/0233415 | A1 | 10/2006 | Chung et al. | |
| 2007/0041595 | A1 | 2/2007 | Carazo et al. | |
| 2007/0122270 | A1 * | 5/2007 | Brueckner | F01D 9/042 415/191 |
| 2007/0291976 | A1 * | 12/2007 | Kajiwara | H04R 11/02 381/400 |
| 2008/0216578 | A1 | 9/2008 | Takashima et al. | |
| 2010/0054509 | A1 | 3/2010 | Thompson | |
| 2010/0110368 | A1 | 5/2010 | Chaum | |
| 2012/0020501 | A1 | 1/2012 | Lee | |
| 2012/0230529 | A1 | 9/2012 | Schumaier et al. | |
| 2013/0329918 | A1 | 12/2013 | Kubba | |
| 2014/0112503 | A1 | 4/2014 | Hebenstreit | |
| 2014/0376751 | A1 * | 12/2014 | Huang | H04R 15/00 381/162 |
| 2015/0141740 | A1 | 5/2015 | Miller | |
| 2016/0021452 | A1 * | 1/2016 | Tang | H04R 9/025 381/151 |
| 2016/0150312 | A1 | 5/2016 | Dong et al. | |
| 2016/0192087 | A1 * | 6/2016 | van Halteren | H04R 23/02 381/312 |

OTHER PUBLICATIONS

Written Opinion of International Application No. PCT/US2017/033800 dated Aug. 18, 2017.

* cited by examiner

Top View

Cross Section View

Top View

Cross Section View

CROSS SECTION VIEW

BONE CONDUCTION TRANSDUCER WITH INCREASED LOW FREQUENCY PERFORMANCE

BACKGROUND

Wireless audio speakers may provide a user with untethered listening experiences via devices such as wireless headphones, earbuds, or in-ear monitors. Such audio devices may include a battery, which may be charged using wired means, such as conductive charging via a charging plug/port, or wireless charging, such as inductive or resonant charging.

Bone-conduction transducers vibrate a listener's bone structure (e.g., portions of a person's skull) to provide perceivable audio signals via the inner ear.

SUMMARY

Certain audio devices may be implemented as wearable devices. Audio may be provided from a wearable device to a user using a bone conduction transducer (BCT). Although BCTs may be effective in providing audio, they may suffer inefficiency at audio frequencies below a resonant frequency of the BCT. To increase the efficiency, a BCT may be constructed that (i) has the magnets of the BCT mounted on a vibration portion of the BCT and (ii) has several components of the BCT constructed from high permeability steel in order to increase the magnetic flux driving the BCT.

In one aspect, the present disclosure includes a bone conduction transducer. The bone conduction transducer includes a yoke having a pair of arms. A first arm is located at a first end of the yoke and a second arm is located at a second end of the yoke. The bone conduction transducer also includes a metal coil located between the pair of arms. Further, the bone conduction transducer includes a pair of springs each having a first end and second end. The first end of each spring is attached to one of the respective arms. The bone conduction transducer additionally includes a diaphragm coupled to the second end of each spring. The diaphragm is configured to vibrate in response to a signal supplied to the metal coil. The bone conduction transducer also includes a metallic post made from high permeability steel. The metallic post extends into a center portion of the metal coil. Yet further, the bone conduction transducer includes pair of permanent magnets coupled to the diaphragm, the permanent magnets are each located on opposite sides of the metallic post.

In another aspect, the present disclosure includes a wearable computing system. The wearable computing system includes a support structure. One or more portions of the support structure are configured to contact a wearer. The wearable computing system also includes an audio interface for receiving an audio signal. Additionally, the wearable computing system includes a vibration transducer. The vibration transducer includes a yoke having a pair of arms. A first arm is located at a first end of the yoke and a second arm is located at a second end of the yoke. The vibration transducer also includes a metal coil located between the pair of arms. Further, the vibration transducer includes a pair of springs each having a first end and second end. The first end of each spring is attached to one of the respective arms. The vibration transducer additionally includes a diaphragm coupled to the second end of each spring. The diaphragm is configured to vibrate in response to a signal supplied to the metal coil. The vibration transducer includes an anvil coupled to the diaphragm. The vibration transducer also includes a metallic post made from high permeability steel.

The metallic post extends into a center portion of the metal coil. Yet further, the vibration transducer includes pair of permanent magnets coupled to the diaphragm, the permanent magnets are each located on opposite sides of the metallic post. Additionally, each permanent magnet has a surface opposite the diaphragm with a layer of high permeability steel thereon.

In another aspect, the present disclosure includes method of assembling a vibration transducer. The method includes positioning a first flexible support arm, having a first end and a second end, such that the first end is positioned over a first mounting surface of a magnetic diaphragm. The method also includes positioning the first flexible support arm such that the second end is positioned over a sidewall of a frame of the vibration transducer. Overlapping regions of the first and second ends of the first flexible support arm overlap the first mounting surface of the magnetic diaphragm and the first sidewall of the frame, respectively. The method also includes positioning a second flexible support arm, having a first end and a second end such that the first end is positioned over a second mounting surface of the magnetic diaphragm. The second mounting surface and the first mounting surface are on opposing sides of the magnetic diaphragm. The method also includes positioning the second flexible support arm such that the second end is positioned over a sidewall of the frame. Overlapping regions of the first and second ends of the second flexible support arm overlap the second mounting surface of the magnetic diaphragm and the sidewall of the frame, respectively. The method yet further includes positioning a metal coil on a flat surface between the two sidewalls of the frame. Additionally, the method includes arranging a post coupled to the magnetic diaphragm, wherein the post is configured to extend into a center portion of the metal coil. The method further includes attaching a pair of permanent magnets attached to the magnetic diaphragm, where the permanent magnets each flank the post and each permanent magnet has a layer of high permeability steel on a bottom portion.

These as well as other aspects, advantages, and alternatives, will become apparent to those of ordinary skill in the art by reading the following detailed description, with reference where appropriate to the accompanying drawings.

DETAILED DESCRIPTION

Figure 1:
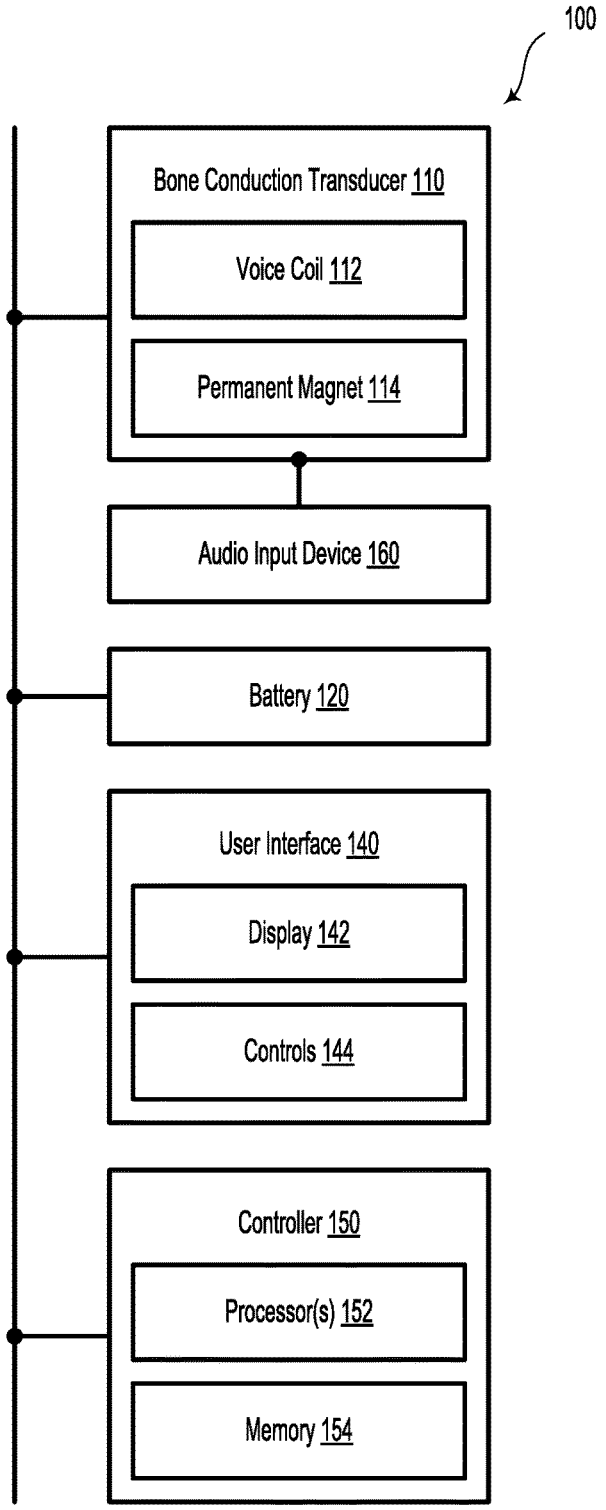
FIG. 1 illustrates a schematic diagram of a system, according to an example embodiment.

Example methods and systems are described herein. It should be understood that the words "example" and "examplary" are used herein to mean "serving as an example, instance, or illustration." Any embodiment or feature described herein as being an "example" or "examplary" is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

I. Overview

Some wearable devices may include a bone-conduction speaker that may take the form of a bone conduction transducer ("BCT"). A BCT may be operable to vibrate the wearer's bone structure at a location where the vibrations travel through the wearer's bone structure to the middle or inner ear, such that the brain interprets the vibrations as sounds. The wearable device may take the form of an earpiece with a BCT, which can be tethered via a wired or wireless interface to a user's phone, or may be a standalone earpiece device with a BCT. Alternatively, the wearable device may be a glasses-style wearable device that includes one or more BCTs and has a form factor that is similar to traditional eyeglasses.

Traditionally, BCTs may be composed of a yoke, which acts as a base of the BCT, a coil and magnets located on top of the yoke, and a pair springs and an anvil that are attached so that they cover up the coil and magnets. Current BCTs may use non-magnetic stainless steel grade SUS 301 as material for the yoke. Although this design may be mechanically robust, the magnetic flux may be diverted by the arms of the yoke away from the coil.

A BCT with higher efficiency, especially at lower frequencies, may be desired. A more efficient BCT may translate to a more sensitive BCT that leads to an increase in sound volume (loudness) compared to a less efficient BCT. This increase in efficiency may be due to flux being unimpeded by the yoke as it runs through the anvil and other BCT components. Further, by increasing the efficiency of the BCT, the electrical power used to drive the BCT during its operation may be reduced.

According to an example embodiment, efficiency of a BCT may be increased by locating the permanent magnets and the post on a bottom surface of the diaphragm. In this example embodiment, the permanent magnets and the post become a portion of the vibrating components of the BCT. Additionally, by including a Cold Rolled Electroless Nickel Plated Low Carbon Steel (SPCD) layer on top of the SUS301 yoke and including an SPCD layer on a bottom surface of the permanent magnets, the efficiency of the BCT may be further increased. Efficiency can be increased in two ways. One, by moving the permanent magnets and the post to the diaphragm, the vibrating mass in increased. This causes the resonant frequency of the vibrating components to shift to a lower frequency. Two, the inclusion of SPCD, a high magnetic permeability material, causes a more efficient magnetic flux path between the various components of the BCT. As a result, the BCT may operate more efficiently compared to traditional BCTs.

Some other examples of high permeability materials that can be used instead of SPCD include, cold rolled steel SAE-1030 (SPCD), JIS G 3141 (SPCC), and Hiperco® 50 alloy. Other high permeability materials may be used as well. Typically, high permeability steel is ferromagnetic and has a saturation point of greater than about 1.5 Tesla for a specified coercivity (i.e., the resistance to change in magnetization of a magnetic material). In some examples, the B-H curve (i.e., the relationship of the Magnetic Flux Density (B) versus the Magnetic Field Strength (H)) of the high permeability steel has a permeability value much less than 1 for the loading portion of the non-linear B-H curve. The loading portion of the B-H curve is typically greater than about 500. Bonding of the SPCD to various surfaces in the BCT may be achieved by, for example, using hot melt glue, acrylic glue, or through spot or laser welding.

II. Illustrative Wearable Devices

Systems and devices in which example embodiments may be implemented will now be described in greater detail. However, an example system may also be implemented in or take the form of other devices, without departing from the scope of the invention.

An example embodiment may be implemented in a wearable computer having a head-mounted display (HMD) or any type of device having a glasses-like form factor. Further, an example embodiment involves an ear-piece with a bone-conduction speaker (e.g., a vibration transducer). The ear-piece may be configured to be attached to a glasses-style support structure, such that when the support structure is worn, the ear-piece extends from the support structure to contact the bone-conduction speaker at the back of the wearer's ear. For instance, the ear-piece may be located on the hook-like section of a side arm, which extends behind a wearer's ear and helps keep the glasses in place. Accordingly, the ear-piece may extend from the side arm to contact the back of the wearer's ear at the auricle, for instance.

In another aspect, the ear-piece may be spring-loaded so that the bone-conduction speaker fits comfortably and securely against the back of the wearer's ear. For instance, the ear-piece may include an extendable member, which is connected to the glasses on one end and is connected to the bone-conduction speaker on the other end. A spring mechanism may accordingly serve to hold the end of the member having the bone-conduction speaker away from the side-arm when the glasses are not being worn. The spring mechanism may be implemented with a pair of cantilevered arms (also referred to as cantilevered springs), which are coupled to and vibrate with a diaphragm that transfers vibration to the wearer.

Further, the spring mechanism may hold the member in a position such that when a wearer puts the glasses on, the back of a wearer's ear (e.g., the auricle) will push against the bone conduction speaker. More specifically, the BCT may be arranged such that when the device is worn, the second end of the member is pushed back towards the side arm (possibly being pressed flush against the sidearm). In this manner, the spring mechanism and member may combine to form a flexible ear-piece, such that when the glasses-style device is worn, the bone-conduction speaker is comfortably pressed against the back of the wearer's ear.

FIG. 1 illustrates a schematic diagram of a system 100, according to an example embodiment. The system 100 includes a BCT 110, a battery 120, an optional user interface 140, and a controller 150.

The BCT 110 includes a voice coil 112 and a permanent magnet 114. The BCT 110 may include a hands-free headset or headphones. Alternatively, BCT 110 may be a boneanchored hearing aid, an implantable bone conduction device, or another type of assistive listening device. In some embodiments, BCT 110 may include an underwater communication device or another type of listening device. Generally, BCT 110 may include a device operable to stimulate auditory sensations via one or more of distortional bone-conduction, inertial bone-conduction, or osseotympanic bone-conduction. As used herein, BCT 110 may refer to a single transducer (e.g., for mono listening), two transducers (e.g., for stereo listening), or more transducers. Furthermore, although the term "bone conduction" is used with respect to BCT 110, it is understood that BCT 110 may relate to a variety of transducers configured to convey sound fully or partially through contact with a body, through bone or other structures such as cartilage.

Voice coil 112 may include insulated wire, also known as magnet wire, wrapped in a simple coil or a toroid shape. In the case of a simple coil, the insulated wire may be wrapped so that it has an open space within which a cylindrical core that may include air, plastic, or a ferromagnetic material may be located. In the case of a toroid shape, the insulated wire may be wrapped around a ring- or donut-shaped core of plastic or ferromagnetic material. Other wire wrapping geometries are contemplated. In an example embodiment, voice coil 112 may include a turn radius of approximately 2 mm. Voice coil 112 may include copper wire with a phenolic resin (enamel) coating. For example, the coating may include a polyvinyl acetal-phenol aldehyde resin or other similar materials. Other types of electrically-insulating coatings are possible, such as polyimide, polyester, or polyvinyl. In an example embodiment, voice coil 112 may include wire having a diameter of about 90 microns (e.g., AWG 39 or SWG 43), however other wire thicknesses and corresponding wire gauges are contemplated.

Voice coil 112 may be considered an inductor, or a device configured to resist changes in electrical current passing through it. Voice coil 112 may include a characteristic inductance L, which is equivalent to the ratio of the voltage to the rate of change of current, $$L = v(t) \Big/ \frac{di(t)}{dt},$$

where v(t) is the time-varying voltage across voice coil 112 and i(t) is the time-varying current through voice coil 112. The inductance of voice coil 112 may be expressed in units of a Henry (H).

In an example embodiment, the inductance of voice coil 112 may be greater than 1 milliHenry (mH) with an impedance of 8 ohms (Ω). As such, in some embodiments, voice coil 112 may generally have a larger inductance than other types of voice coils, such as those in speakers, ear buds, microspeakers, etc. Other inductance values are possible for voice coil 112.

Permanent magnet 114 may include one or more ferromagnetic materials such as iron, cobalt, nickel, rare earth metals, etc. In an example embodiment, permanent magnet 114 may include alnico, ferrite, or neodymium-iron-boron (NdFeB). Other magnetic materials are contemplated.

In an example embodiment, the inductance of voice coil 112 may be controlled by, for example, adjusting its position with respect to a pole piece and/or permanent magnet 114.

The BCT 110 may be coupled to an audio input device 160. The audio input device 160 may take many forms across various embodiments. The audio input device 160 is configured to supply an audio signal to the voice coil 112. The audio input device may receive audio signals from a wired device, wireless device, or from the processor(s) 152 of the device.

BCT 110 may include other elements, such as a yoke, a housing, an armature coupled to permanent magnet 114 and/or the housing, one or more springs or damping devices coupled to the armature and/or the housing, and electrical connections to voice coil 112.

Battery 120 may include a secondary (rechargeable) battery. Among other possibilities, battery 120 may include one or more of a nickel-cadmium (NiCd) cell, a nickel-zinc (NiZn) cell, a nickel metal hydride (NiMH) cell, or a lithium-ion (Li-ion) cell. Battery 120 may be operable to provide electrical power for BCT 110 and other elements of system 100. In an example embodiment, battery 120 may be electrically coupled to a battery charging circuit.

User interface 140 may include an optional display 142 and controls 144. Display 142 may be configured to provide images to a user of system 100. In an example embodiment, display 142 may be at least partially see-through so that a user may view at least a portion of the environment by looking through display 142. In such a scenario, display 142 may provide images overlaid on the field of view of the environment. In some embodiments, display 142 may be configured to provide the user with an augmented reality or a virtual reality experience.

Controls 144 may include any combination of switches, buttons, audio commands, touch-sensitive surfaces, and/or other user input devices. A user may monitor and/or adjust the operation of system 100 via controls 144.

System 100 may optionally include a communication interface (not illustrated) that may allow system 100 to communicate, using analog or digital modulation, with other devices, access networks, and/or transport networks. Specifically, the communication interface may be configured to communicate with the internet. In some embodiments, the communication interface may facilitate circuit-switched and/or packet-switched communication, such as plain old telephone service (POTS) communication and/or Internet protocol (IP) or other packetized communication. For instance, the communication interface may include a chipset and antenna arranged for wireless communication with a radio access network or an access point. Also, the communication interface may take the form of or include a wireline interface, such as an Ethernet, Universal Serial Bus (USB), or High-Definition Multimedia Interface (HDMI) port. The communication interface may also take the form of or include a wireless interface, such as a Wifi, BLUETOOTH®, BLUETOOTH LOW ENERGY®, global positioning system (GPS), or wide-area wireless interface (e.g., WiMAX or 3GPP Long-Term Evolution (LTE)). However, other forms of physical layer interfaces and other types of standard or proprietary communication protocols may be used over the communication interface. Furthermore, the communication interface may include multiple physical communication interfaces (e.g., a Wifi interface, a BLUETOOTH® interface, and a wide-area wireless interface).

Controller 150 may include one or more processor(s) 152 and a memory 154, such as a non-transitory computer readable medium. Controller 150 may include at least one processor 152 and a memory 154. Processor 152 may include one or more general purpose processors—e.g., microprocessors—and/or one or more special purpose processors—e.g., image signal processors (ISPs), digital signal processors (DSPs), graphics processing units (GPUs), floating point units (FPUs), network processors, or applicationspecific integrated circuits (ASICs). In an example embodiment, controller 150 may include one or more audio signal processing devices or audio effects units. Such audio signal processing devices may process signals in analog and/or digital audio signal formats. Additionally or alternatively, processor 152 may include at least one programmable in-circuit serial programming (ICSP) microcontroller. Memory 154 may include one or more volatile and/or non-volatile storage components, such as magnetic, optical, flash, or organic storage, and may be integrated in whole or in part with the processor 152. Memory 154 may include removable and/or non-removable components.

Processor 152 may be capable of executing program instructions (e.g., compiled or non-compiled program logic and/or machine code) stored in memory 154 to carry out the various functions described herein. Therefore, memory 154 may include a non-transitory computer-readable medium, having stored thereon program instructions that, upon execution by computing device 100, cause computing device 100 to carry out any of the methods, processes, or operations disclosed in this specification and/or the accompanying drawings. The execution of program instructions by processor 152 may result in processor 152 using data provided by various other elements of the computing device 100. In an example embodiment, the controller 150 may include a distributed computing network and/or a cloud computing network.

Figure 2:
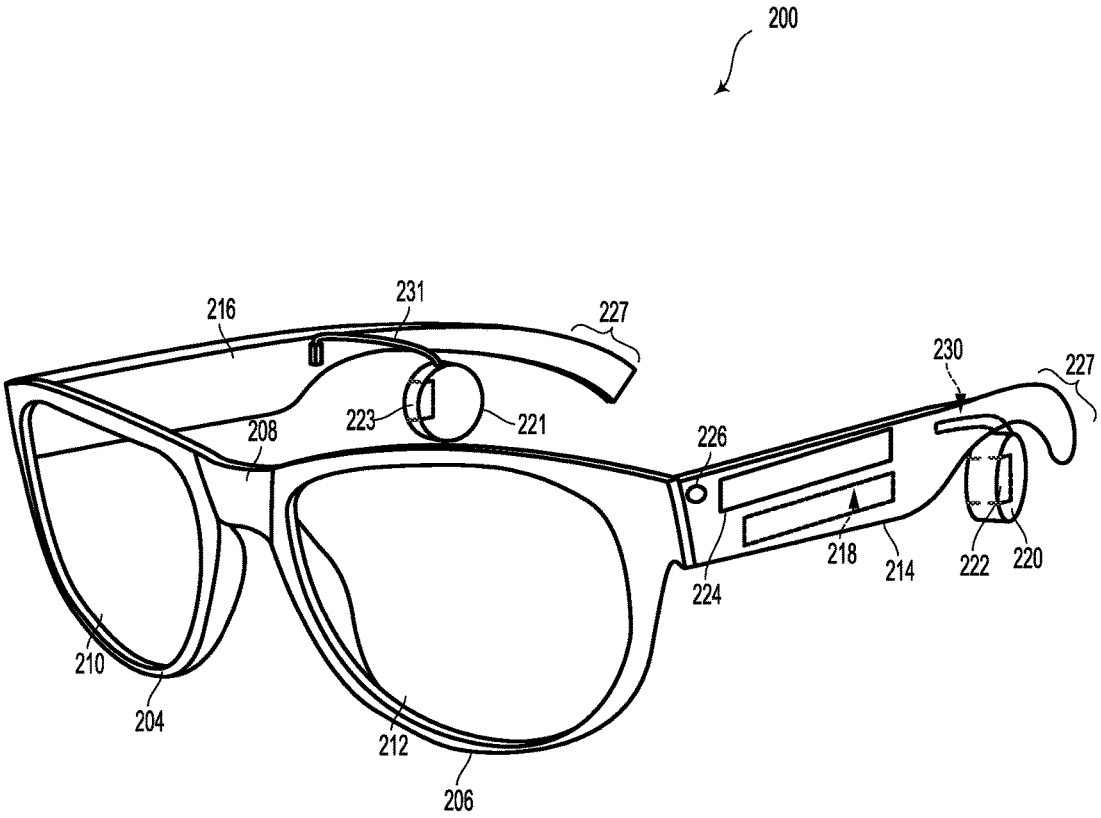
FIG. 2 illustrates a wearable device, according to example embodiments.

FIG. 2 illustrates a non-limiting example of a wearable device as contemplated in the present disclosure. As such, system 100 as illustrated and described with respect to FIG. 1 may take the form of a wearable device, such as wearable device 200. The system 100 may take other forms as well. For example, the system 100 may take the form of body worn devices that are not in the eye glasses form factor.

FIG. 2 illustrates a wearable device 200, according to an example embodiment. Wearable device 200 may be shaped similar to a pair of glasses or another type of head-mountable device. As such, wearable device 200 may include frame elements including lens-frames 204, 206 and a center frame support 208, lens elements 210, 212, and extending side-arms 214, 216. The center frame support 208 and the extending side-arms 214, 216 are configured to secure the wearable device 200 to a user's head via placement on a user's nose and ears, respectively.

Each of the frame elements 204, 206, and 208 and the extending side-arms 214, 216 may be formed of a solid structure of plastic and/or metal, or may be formed of a hollow structure of similar material so as to allow wiring and component interconnects to be internally routed through the wearable device 200. Other materials are possible as well. Each of the lens elements 210, 212 may also be sufficiently transparent to allow a user to see through the lens element.

Additionally or alternatively, the extending side-arms 214, 216 may be positioned behind a user's ears to secure the wearable device 200 to the user's head. The extending side-arms 214, 216 may further secure the wearable device 200 to the user by extending around a rear portion of the user's head. Additionally or alternatively, for example, the wearable device 200 may connect to or be affixed within a head-mountable helmet structure. Other possibilities exist as well.

Wearable device 200 may also include an on-board computing system 218 and at least one finger-operable touch pad 224. The on-board computing system 218 is shown to be integrated in side-arm 214 of wearable device 200. However, an on-board computing system 218 may be provided on or within other parts of the wearable device 200 or may be positioned remotely from, and communicatively coupled to, a head-mountable component of a computing device (e.g., the on-board computing system 218 could be housed in a separate component that is not head wearable, and is wired or wirelessly connected to a component that is head wearable). The on-board computing system 218 may include a processor and memory, for example. Further, the on-board computing system 218 may be configured to receive and analyze data from a finger-operable touch pad 224 (and possibly from other sensory devices and/or user interface components).

In a further aspect, wearable device 200 may include various types of sensors and/or sensory components. For instance, wearable device 200 could include an inertial measurement unit (IMU) (not explicitly illustrated in FIG. 2), which provides an accelerometer, gyroscope, and/or magnetometer. In some embodiments, wearable device 200 could also include an accelerometer, a gyroscope, and/or a magnetometer that is not integrated in an IMU.

In a further aspect, the wearable device, such as wearable device 200, may include sensors that facilitate a determination as to whether or not the wearable device 200 is being worn. For instance, sensors such as an accelerometer, gyroscope, and/or magnetometer could be used to detect motion that is characteristic of wearable device 200 being worn (e.g., motion that is characteristic of user walking about, turning their head, and so on), and/or used to determine that the wearable device 200 is in an orientation that is characteristic of the wearable device 200 being worn (e.g., upright, in a position that is typical when the wearable device 200 is worn over the ear). Accordingly, data from such sensors could be used as input to an on-head detection process. Additionally or alternatively, the wearable device 200 may include a capacitive sensor or another type of sensor that is arranged on a surface of the wearable device 200 that typically contacts the wearer when the wearable device 200 is worn. Accordingly, data provided by such a sensor may be used to determine whether the wearable device 200 is being worn. Other sensors and/or other techniques may also be used to detect when the wearable device 200 is being worn.

The wearable device 200 also includes at least one microphone 226, which may allow the wearable device 200 to receive voice commands from a user. The microphone 226 may be a directional microphone or an omni-directional microphone. Further, in some embodiments, the wearable device 200 may include a microphone array and/or multiple microphones arranged at various locations on the wearable device 200.

In a further aspect, earpiece 220 and 211 are attached to side-arms 214 and 216, respectively. Earpieces 220 and 221 may each include a BCT 222 and 223, respectively. BCT 222 and 223 may be similar or identical to BCT 110 as illustrated and described in reference to FIG. 1. Each earpiece 220, 221 may be arranged such that when the wearable device 200 is worn, each BCT 222, 223 is positioned to the posterior of a wearer's ear. For instance, in an exemplary embodiment, an earpiece 220, 221 may be arranged such that a respective BCT 222, 223 can contact the auricle of both of the wearer's ears and/or other parts of the wearer's head. Other arrangements of earpieces 220, 221 are also possible. Further, embodiments with a single earpiece 220 or 221 are also possible.

In an exemplary embodiment, BCT 222 and/or BCT 223 may operate as a bone-conduction speaker. BCT 222 and 223 may be, for example, a vibration transducer, an electro-acoustic transducer, or a variable reluctance transducer that produces sound in response to an electrical audio signal input. Generally, a BCT may be any structure that is operable to directly or indirectly vibrate the bone structure or pinnae of the user. For instance, a BCT may be implemented with a vibration transducer that is configured to receive an audio signal and to vibrate a wearer's bone structure or pinnae in accordance with the audio signal.

As illustrated in FIG. 2, wearable device 200 need not include a graphical display. However, in some embodiments, wearable device 200 may include such a display. In particular, the wearable device 200 may include a near-eye display (not explicitly illustrated). The near-eye display may be coupled to the on-board computing system 218, to a stand-alone graphical processing system, and/or to other components of the wearable device 200. The near-eye display may be formed on one of the lens elements of the wearable device 200, such as lens element 210 and/or 212. As such, the wearable device 200 may be configured to overlay computer-generated graphics in the wearer's field of view, while also allowing the user to see through the lens element and concurrently view at least some of their real-world environment. In other embodiments, a virtual reality display that substantially obscures the user's view of the surrounding physical world is also possible. The near-eye display may be provided in a variety of positions with respect to the wearable device 200, and may also vary in size and shape. Other types of near-eye displays are also possible. For example, a glasses-style wearable device may include one or more projectors (not illustrated) that are configured to project graphics onto a display on a surface of one or both of the lens elements of the wearable device 200.

In other examples, the wearable device may take a form that is not a glasses-type support structure. In some examples, the wearable device may be a behind-ear housing configured to be worn on a wearer's ear(s). A behind-ear housing may be configured to hook over a wearer's ear(s).

III. Illustrative Computing Devices

Figure 3:
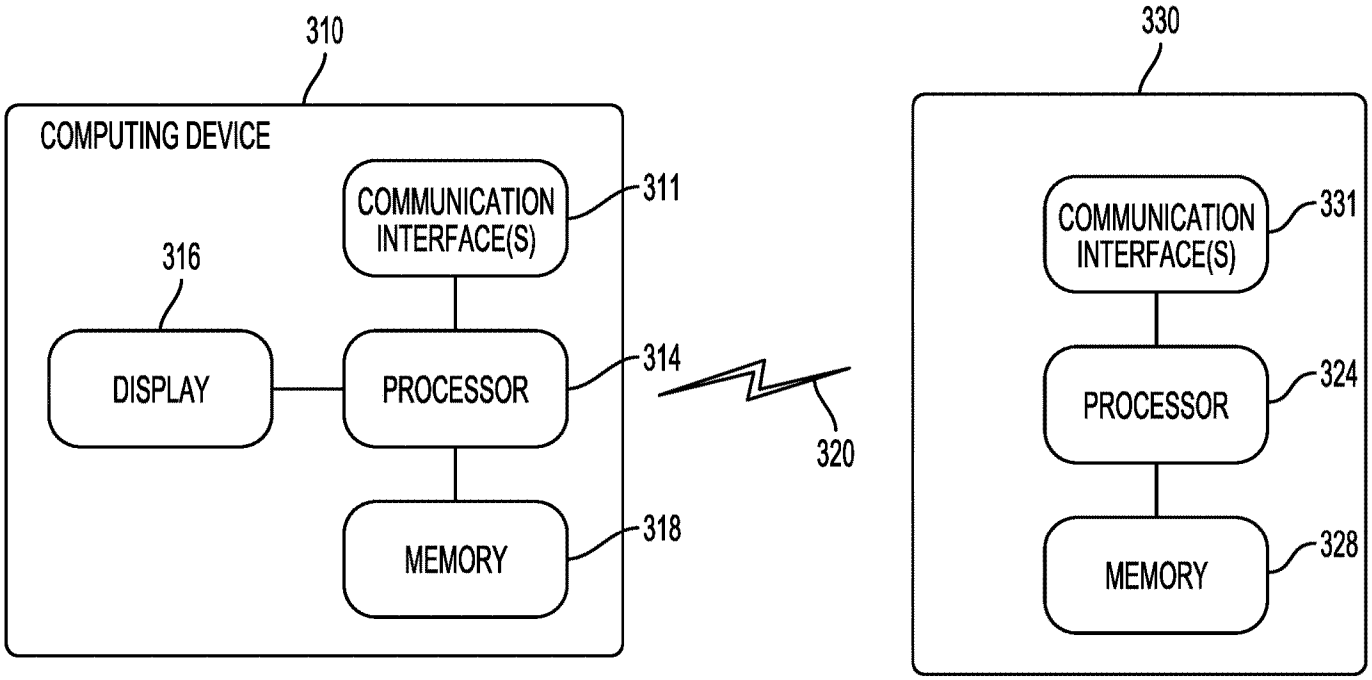
FIG. 3 illustrates a block diagram showing components of a computing device and a wearable computing device, according to an example embodiment.

FIG. 3 is a block diagram showing basic components of a computing device 310 and a wearable computing device 330, according to an example embodiment. In an example configuration, computing device 310 and wearable computing device 330 are operable to communicate via a communication link 320 (e.g., a wired or wireless connection). Computing device 310 may be any type of device that can receive data and display information corresponding to or associated with the data. For example, the computing device 310 may be a mobile phone, a tablet computer, a laptop computer, a desktop computer, or an in-car computer, among other possibilities. Wearable computing device 330 may be a wearable computing device such as those described in reference to FIGS. 1 and 2, a variation on these wearable computing devices, or another type of wearable computing device altogether.

The wearable computing device 330 and computing device 310 include hardware and/or software to enable communication with one another via the communication link 320, such as processors, transmitters, receivers, antennas, etc. In the illustrated example, computing device 310 includes one or more communication interfaces 311, and wearable computing device 330 includes one or more communication interfaces 331. As such, the wearable computing device 330 may be tethered to the computing device 310 via a wired or wireless connection. Note that such a wired or wireless connection between computing device 310 and wearable computing device 330 may be established directly (e.g., via Bluetooth), or indirectly (e.g., via the Internet or a private data network).

In a further aspect, note that while computing device 310 includes a graphic display system 316, the wearable computing device 330 does not include a graphic display. In such a configuration, wearable computing device 330 may be configured as a wearable audio device, which allows for advanced voice control and interaction with applications running on another computing device 310 to which it is tethered.

As noted, communication link 320 may be a wired link, such as a universal serial bus or a parallel bus, or an Ethernet connection via an Ethernet port. A wired link may also be established using a proprietary wired communication protocol and/or using proprietary types of communication interfaces. The communication link 320 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities.

As noted above, to communicate via communication link 320, computing device 310 and wearable computing device 330 may each include one or more communication interface(s) 311 and 331 respectively. The type or types of communication interface(s) included may vary according to the type of communication link 320 that is utilized for communications between the computing device 310 and the wearable computing device 330. As such, communication interface(s) 311 and 331 may include hardware and/or software that facilitates wired communication using various different wired communication protocols, and/or hardware and/or software that facilitates wireless communications using various different wired communication protocols.

Computing device 310 and wearable computing device 330 include respective processing systems 314 and 324. Processors 314 and 324 may be any type of processor, such as a micro-processor or a digital signal processor, for example. Note that computing device 310 and wearable computing device 330 may have different types of processors, or the same type of processor. Further, one or both of computing device 310 and a wearable computing device 330 may include multiple processors.

Computing device 310 and a wearable computing device 330 further include respective on-board data storage, such as memory 318 and memory 328. Processors 314 and 324 are communicatively coupled to memory 318 and memory 328, respectively. Memory 318 and/or memory 328 (any other data storage or memory described herein) may be computer-readable storage media, which can include volatile and/or non-volatile storage components, such as optical, magnetic, organic or other memory or disc storage. Such data storage can be separate from, or integrated in whole or in part with one or more processor(s) (e.g., in a chipset).

Memory 318 can store machine-readable program instructions that can be accessed and executed by the processor 314. Similarly, memory 328 can store machine-readable program instructions that can be accessed and executed by the processor 324.

In an example embodiment, memory 318 may include program instructions stored on a non-transitory computer-readable medium and executable by the at least one processor to provide a graphical user-interface (GUI) on a graphic display 316. The GUI may include a number of interface elements to adjust lock-screen parameters of the wearable computing device 330 and the computing device 310. These interface elements may include: (a) an interface element for adjustment of an unlock-sync feature, wherein enabling the unlock-sync feature causes the wearable audio device to operate in an unlocked state whenever the master device is in an unlocked state, and wherein disabling the unlock-sync feature allows the wearable audio device to operate in a locked state when the master device is in an unlocked state, and (b) an interface element for selection of a wearable audio device unlock process, wherein the selected wearable audio device unlock process provides a mechanism to unlock the wearable audio device, independent from whether the master device is in the locked state or the unlocked state.

In a further aspect, a communication interface 311 of the computing device 310 may be operable to receive a communication from the wearable audio device that is indicative of whether or not the wearable audio device is being worn. Such a communication may be based on sensor data generated by at least one sensor of the wearable audio device. As such, memory 318 may include program instructions providing an on-head detection module. Such program instructions may to: (i) analyze sensor data generated by a sensor or sensors on the wearable audio device to determine whether or not the wearable audio device is being worn; and (ii) in response to a determination that the wearable audio device is not being worn, lock the wearable audio device (e.g., by sending a lock instruction to the wearable audio device).

IV. Example Bone-Conduction Ear-Pieces and Arrangements Thereof

Figure 4A:
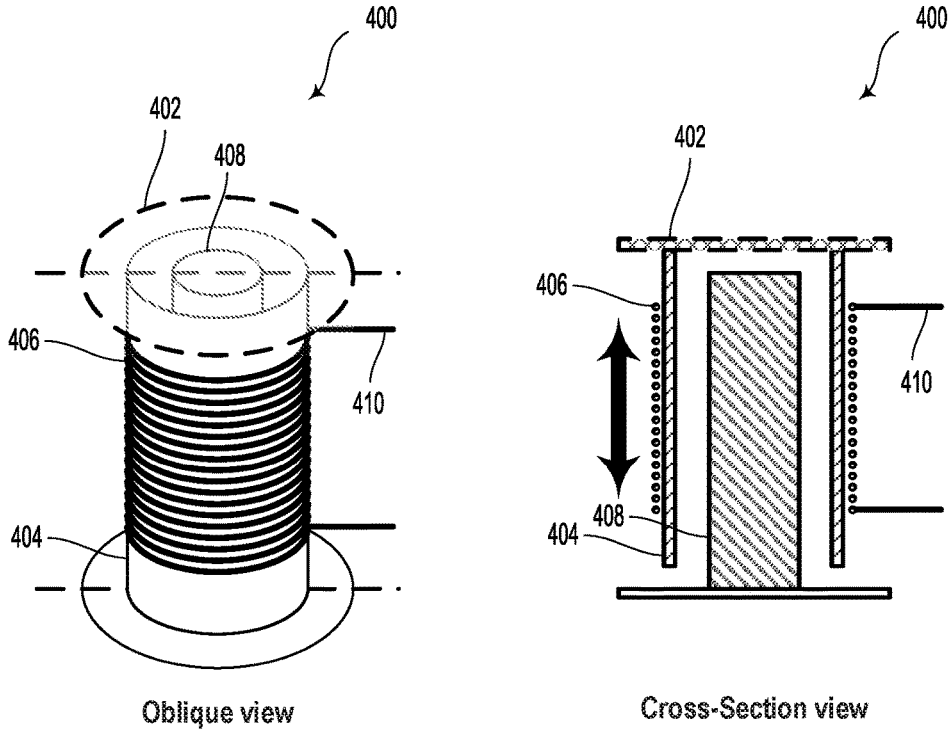
FIG. 4A illustrates a voice coil and a permanent magnet scenario, according to an example embodiment.

FIG. 4A illustrates a voice coil and a permanent magnet scenario 400, according to an example embodiment. Scenario 400 includes a voice coil 406, which may consist of insulated wire wrapped around a hollow cylindrical core 404. Voice coil 406 may interact with a magnetic field of permanent magnet 408. Cylindrical core 404 may be coupled to an actuatable surface 402. That is, as illustrated in FIG. 4A, actuatable surface 402 may move up and down with respect to permanent magnet 408 when an alternating current signal is applied to voice coil 406 via electrical contacts 410.

Figure 4B:
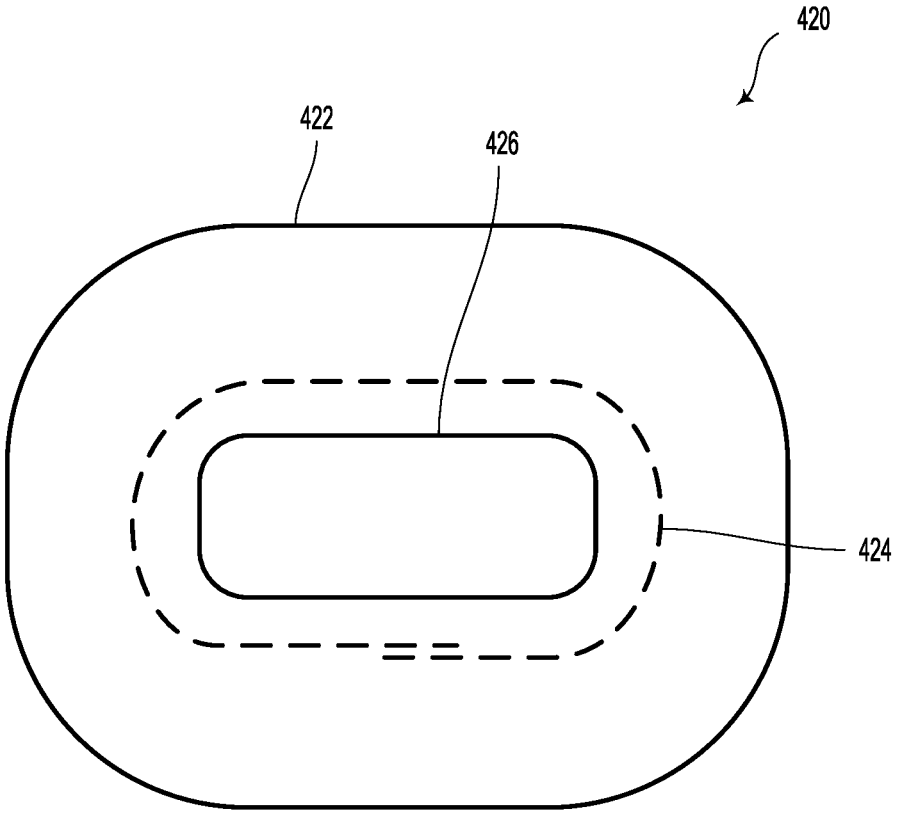
FIG. 4B illustrates a voice coil, according to an example embodiment.
Figure 4B:
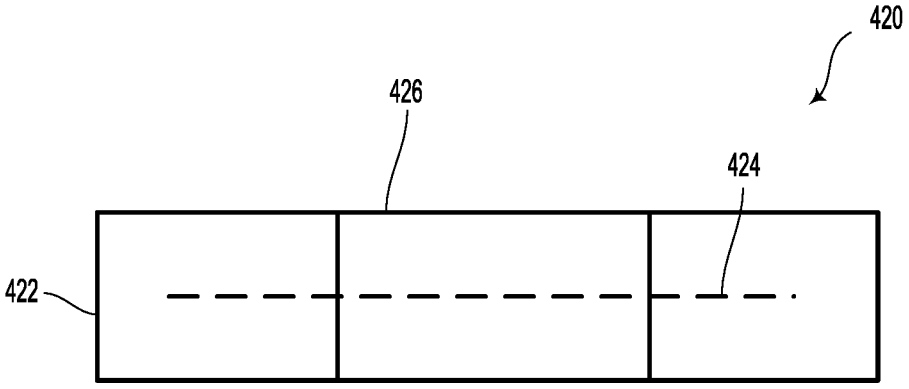

FIG. 4B illustrates a voice coil 420, according to an example embodiment. As illustrated in FIG. 4B, insulated wire 424 may be wrapped in a coil about a central core 426. The coil may have a height of approximately 1.5 mm. In an example embodiment, the central core 426 may have dimensions of approximately 3 mm×1.5 mm. Furthermore, an outer dimension 422 of voice coil 420 may be approximately 5 mm×6 mm, however other coil dimensions are contemplated.

Figure 4C:
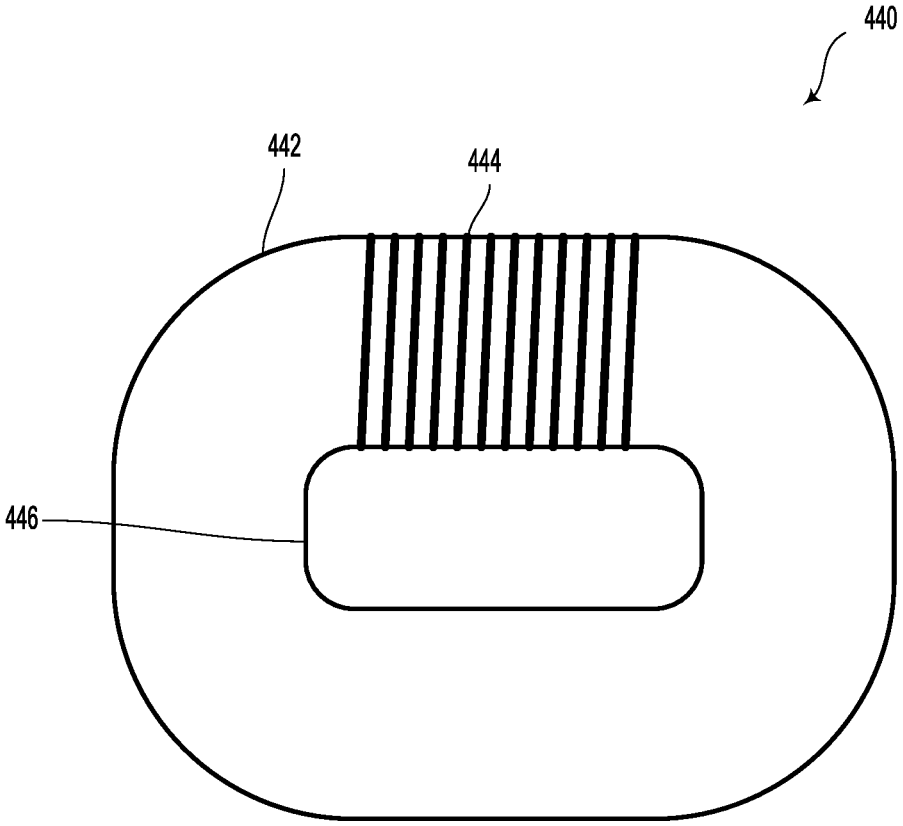
FIG. 4C illustrates a voice coil, according to an example embodiment.
Figure 4C:
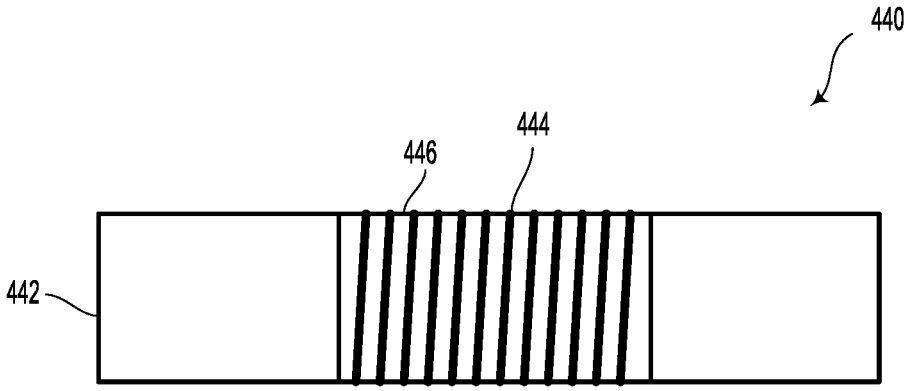

FIG. 4C illustrates a voice coil 440, according to an example embodiment. As illustrated in FIG. 4C, insulated wire 444 may be wrapped in a toroid-shaped coil about a ring- or donut-shaped central core 446. The coil may have a height of approximately 1.5 mm. In an example embodiment, central core 446 may have dimensions of approximately 3 mm×1.5 mm. Furthermore, an outer dimension 442 of voice coil 440 may be approximately 5 mm×6 mm, however other coil dimensions are contemplated. In an example embodiment, voice coil 440 may include between 200-230 wraps about central core 446, however other numbers of wraps are contemplated. In an example embodiment, the inductance of voice coil 440 may be approximately 0.54 mH. Other inductance values are possible and contemplated.

Figure 4D:
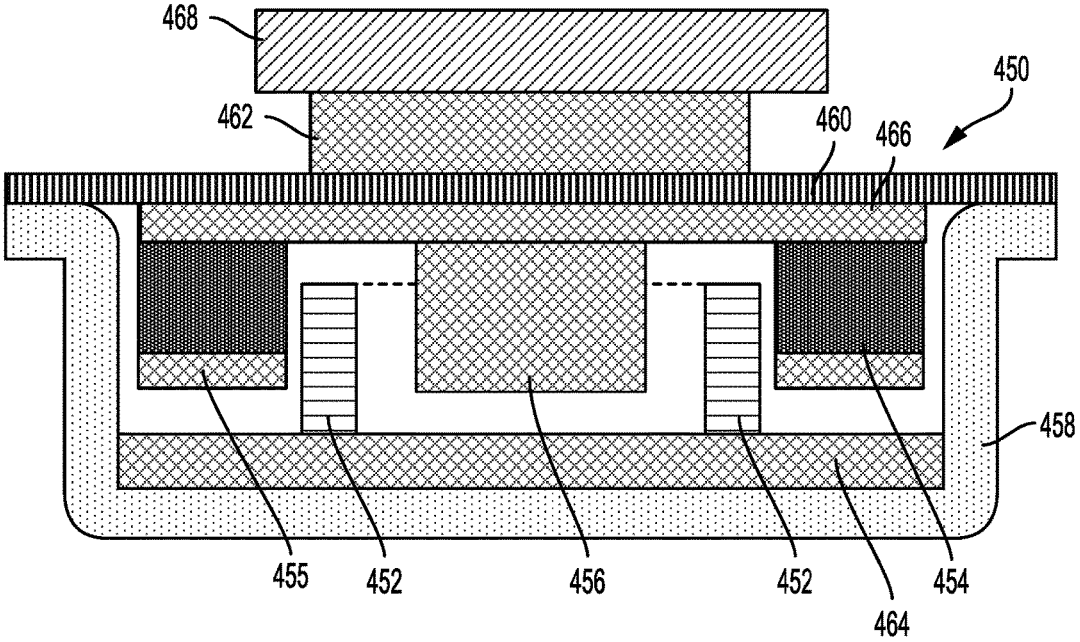
FIG. 4D illustrates a bone conduction transducer, according to an example embodiment.

FIG. 4D illustrates a bone conduction transducer 450, according to an example embodiment. BCT 450 includes a voice coil 452, which may be similar or identical to voice coil 440. Voice coil 452 may be mounted on an SPCD surface 464 coupled to a yoke 458. Voice coil 452 may also be arranged, at least in part, around a pole 456. Pole 456 and permanent magnet 454 may be coupled to a diaphragm 466, which may be coupled to at least one spring 460. At least a portion of spring 460 may be coupled to yoke 458. Spring 460 may also be coupled to an anvil 462, which may or may not be in physical contact with a user of the BCT 450. In some examples, the anvil 462 may have a further vibration coupling interface 468 mounted to its top surface. The vibration coupling interface 468 may be a non-metallic component, such as a plastic, that conducts vibrations from the anvil 462 to a human. In some examples, the vibration coupling interface 468 may be chosen based on a desired frequency response for the BCT. The desired frequency response for the BCT may be based upon an acoustic impedance of the human head.

Spring 460 may be formed from flexible steel or another compliant material. Pole 456 may include steel or another material configured to shape a magnetic field of permanent magnets 454. Permanent magnets 454 may include a neodymium magnet. For example, permanent magnet 454 may include an alloy including neodymium, iron, and boron (NdFeB, or NIB). Other types, shapes, and compositions of permanent magnets 454 are possible. The permanent magnets 454 may include an SPCD cap 455 on the end of the magnets.

Various components of the BCT 450 may be made from a high permeability material, such as SPCD. In some examples, the pole 456, the anvil 462, the SPCD surface 464, and the diaphragm 466 may each be made from various high permeability materials.

When voice coil 452 is electrically connected to a time-varying signal, the magneto-motive force that originates from varying the flux in the highly magnetic parts (e.g., anvil 462, SPCD surface 464, and pole piece 456) causes anvil 462 to perturb about its static offset. In an example embodiment, the static offset is based on an inward pull of the permanent magnets. In such a scenario, the voice coil 452 may remain stationary and the anvil 462 may move with respect to the rest of the assembly. Spring 460 may provide a restoring force to maintain a desired physical arrangement of the moving mass (e.g., anvil 462 and its attachments). In some examples, the permanent magnets 454, the SPCD cap 455, the pole 456, the spring 460, the anvil 462, the diaphragm 466, and the vibration coupling interface 468 may be referred to collectively as the vibrating components, as they are configured to vibrate based on an audio signal.

V. Example Bone Conduction Transducer

Figure 5:
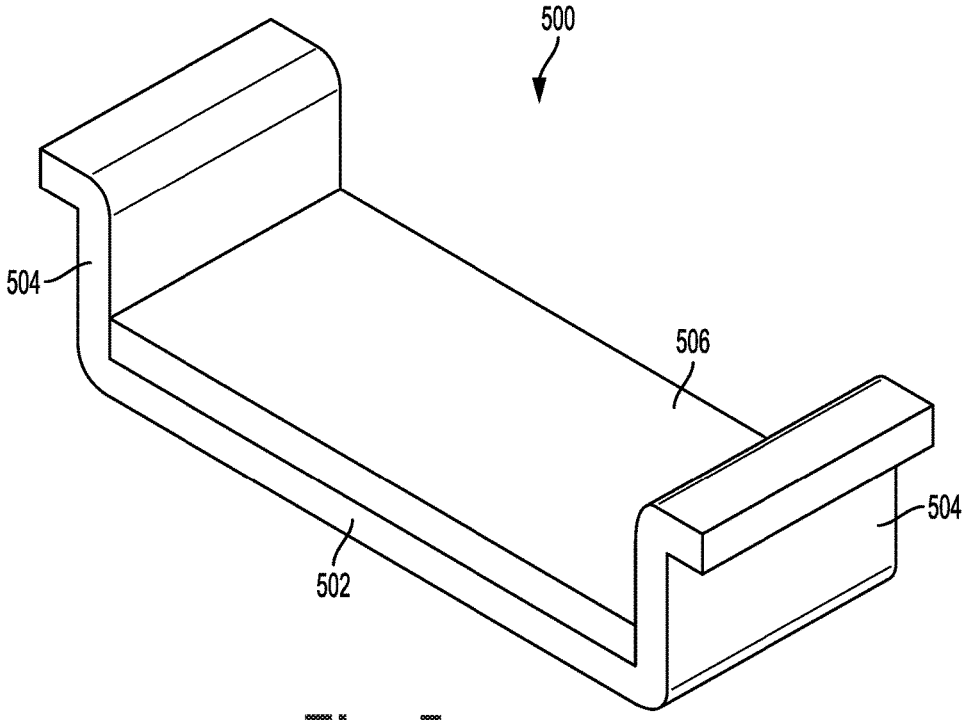
FIG. 5 illustrates a yoke according to an example embodiment.

FIG. 5 illustrates an example composite yoke 500. The composite yoke 500 may consist of a "U" shaped yoke with a flat base section 502 and a pair of arms 504 at each end of the flat base section 502. The composite yoke 500 further consists of a flat piece 506 made from SPCD that is located on top of the flat base section 502 and between the pair of arms 504.

In one embodiment, the flat piece SPCD 506 may be attached to the flat base section 502 of the yoke using acrylic glue or hot ceramic. Both acrylic glue and hot ceramic may bond the SPCD 506 to the flat base section 502 through a heat cycle. The acrylic glue or hot ceramic may be heated up to around 400 degrees Celsius for less than one minute and cooled. The cooling process may consist of natural cooling, where the composite yoke is not put under any forced air using a fan or blower.

The flat base section 502 of the yoke may be of any thickness. In particular, the efficiency of the composite yoke 500 may be substantially independent of the thickness of the flat base section 502. In example embodiments, the flat base section 502 of the yoke is constructed from a single piece of SUS301, and the thickness of the flat piece SPCD 506 is within a range of about 0.7 mm to about 1.0 mm.

Figure 6:
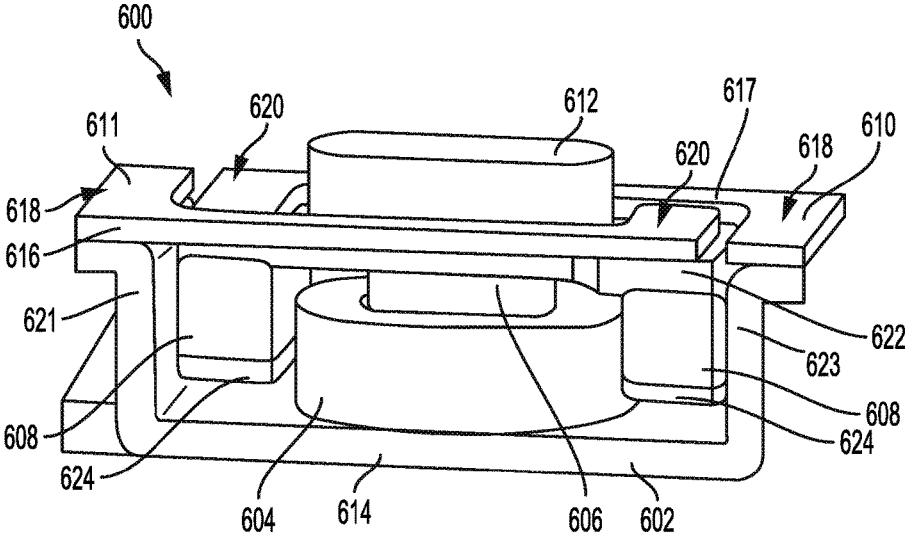
FIG. 6 illustrates a bone conduction transducer according to an example embodiment.

FIG. 6 illustrates a BCT 600 that incorporates a composite yoke. The yoke 602 may be a "U" shaped component that has a flat section 614 and two support arms 616, 617 on each end of the flat section 614. The yoke 602 may be a single piece or may be constructed using multiple pieces. The yoke 602 may be constructed using SUS301 or other non-magnetic stainless steel. On the top side of the flat section 614 of the yoke 602, a single layer of high permeability steel (SPCD) (shown as SPCD 506 of FIG. 5) may be attached. As described above, the SPCD may be attached to the yoke 602 using acrylic glue or hot ceramic. On top of the SPCD, a metal coil 604 may be attached. The coil 604 may be metallic wires that are wrapped to have an opening within which a post 606 may be positioned. Covering the SPCD and the coil 604 are two springs 610, 611 that are each attached to each of the support arms 616, 617 of the yoke 602. The springs 610, 611 are shaped and arranged such that there is a central opening (not shown). An anvil 612 fills the central opening and is attached to each of the springs 610, 611. The anvil 612 may be coupled to a diaphragm that couples to the bottom of the springs (shown as diaphragm 466 of FIG. 4D). The magnets 608 may be coupled to the diaphragm as well. A bottom surface of the magnets 608 may include a layer of SPCD 624.

During the operation of the transducer, the flux in the magnet structure comes from the permanent magnets and traverses through the air gap on the bottom of the magnets then through the flat bottom SPCD and comes back through the anvil and/or diaphragm and completes the circuit back into the bottom of the magnets. Thus, there is a loop formed by the magnetic flux pathway. When high permeability materials, such as SPCD, are used to construct the flat surface on top of yoke, the bottom portion of the magnets, the diaphragm, and post coupled to the diaphragm, magnetic flux travels through the high permeability material as a preferential path, rather than travel through the whole "U" shape of the yoke. This configuration causes the flux in the air gap below the magnets to be greater in the case of without using SPCD.

In some examples, the operation of the transducer depends on the flux generated in the air gap. The attractive force may be directly proportional to the total flux squared divided by the area of the magnets. The total flux may include a static flux generated by the permanent magnets and a dynamic flux caused by the current in the coil. Although the static flux may be dominant, the product of the static and dynamic flux causes the perturbation force driving the vibrations. To provide the transducer with a high efficiency, it is desirable to make the static flux in the gap as high as possible by removing diverting paths for the flux.

In some embodiments, the composite yoke 602 may have little or no effect on the magnetic field generated by the BCT. However, the composite yoke 602 may increase the efficiency of the BCT, with resulting increases in sensitivity of the BCT and output volume of the sound. In some instances, when applying the same amount of electrical power to the coil 604, there may be an increase of approximately 5 decibels, as compared to a BCT with a conventional construction. This may be the result of the magnetic flux running through the various components of the BCT without being impeded by the composite yoke 602, thus reducing the amount of energy lost in the BCT. Additionally, because less power may be used to generate the same sound volume, the BCT may be driven in a more power efficient manner. In some examples, power saved by increasing the BCT efficiency may be used to by the digital signal processor for additional processing. In other examples, the device may simply use less power and not increase the power usage of any component in response to the increase in BCT efficiency.

To operate a BCT, an electrical signal representing an audio signal may be fed through a wire coil. The audio signal in the coil 604 induces a magnetic field that is time-varying. The induced magnetic field varies proportionally to the audio signal applied to the coil. The magnetic field induced by coil 604 may cause a ferromagnetic core post 606 to become magnetized. The core post 606 may be any ferromagnetic material such as iron, nickel, cobalt, or rare earth metals. In some embodiments, the core post 606 may be physically connected to the diaphragm (or springs), like as shown in FIG. 6. Additionally, in various embodiments the core post 606 is a magnet. The diaphragm is configured to vibrate based on magnetic field induced by coil. The diaphragm may be made of a metal or other metallic substance. When an electrical signal propagates through coil 604 it will induce a magnetic field in the core post 606. This magnetic field will couple to the diaphragm and cause diaphragm to responsively vibrate.

Each of the support arms 616, 617 (i.e. springs) includes a leaf spring extension 610, 611 terminating at one end with a frame mount end 618, and terminating at the opposite end with an overlapping diaphragm connection 610, 611. On the first support arm, the leaf spring extension can be formed of a metal, plastic, and/or composite material and has an approximately rectangular cross-section with a height smaller than its width. For example, the approximately rectangular cross section can have rounded corners between substantially straight edges, or can be a shape that lacks straight edges, such as an ellipse or oval with a height smaller than its width. Due to the smaller height, the support arm flexes more readily in a direction transverse to its cross-sectional height than its width, such that the support arm provides flexion (i.e., movement) in a direction substantially transverse to its cross-sectional height, without allowing significant movement in a direction transverse to its cross-sectional width.

In some embodiments, the cross-sectional height and/or width of the support arms 616, 617 can vary along the length of the support arms 616, 617 in a continuous or non-continuous manner such that the support arms 616, 617 provide desired flexion. For example, the cross-sectional height and/or width of the support arms 616, 617 can be gradually tapered across their respectively lengths to provide a change in thickness from one end to the other (e.g., a variation in thickness of 10%, 25%, 50%, etc.). In another example, the cross-sectional height and/or width of the support arms 616, 617 can be relatively small near their respective mid-sections in comparison to their respective ends (e.g., a mid-section with a thickness and/or width of 10%, 25%, 50%, etc. less than the ends). Changes in thickness (i.e., cross-sectional height) and/or width adjust the flexibility of the support arms 616, 617 and thereby change the frequency and/or amplitude response of the diaphragm 622.

Thus, the leaf spring extension 610, 611 can allow the diaphragm 622 to travel toward and away from the wire coil 604 (e.g., parallel to the orientation of the core post 606), without moving substantially side-to-side (e.g., perpendicular to the orientation of the core post 606). The leaf spring extension 610, 611 similarly allows the diaphragm 622 to elastically travel toward and away from the wire coil 604. The frame mount ends 618 can be a terminal portion of the leaf spring extensions 610, 611 that overlaps the support arms 616, 617 when the BCT 600 is assembled. The frame mount ends 618 are securely connected to the respective top surfaces of the support arms 616, 617 to anchor the support arms 616, 617 to the yoke 602. The opposite ends of the support arms 616, 617 extend transverse to the length of the leaf spring extensions to form the overlapping diaphragm mounts. In some embodiments, the leaf spring extensions can resemble the height of an upper-case letter "L" while the respective transverse-extended overlapping diaphragm mounts resemble the base. In some embodiments, such as where the yoke 602 additionally or alternatively includes sidewalls for mounting the support arms 616, 617, the support arms 616, 617 can resemble an upper-case letter "C," with leaf spring extensions formed from the mid-section of the "C" and the bottom and top transverse portions providing mounting surfaces to the diaphragm 622 and the side walls, respectively.

The diaphragm 622 is situated as a rectangular plate situated perpendicular to the orientation of the electromagnet core post 606 with extending mounting surfaces. The diaphragm 622 includes an outward anvil 612 and opposite coil-facing surface, and mounting surfaces extending outward from the anvil 612. The mounting surfaces can be in a parallel plane to the anvil 612, with both in a plane approximately perpendicular to the orientation of the core post 606. The mounting surfaces 620 interface with the overlapping diaphragm mounts to elastically suspend the diaphragm 622 over the electromagnetic coil 604.

In some embodiments, the anvil 612 is rectangular and oriented in approximately the same direction as the base platform of the yoke 602. The mounting surfaces can optionally project along the length of the rectangular diaphragm 622 to underlap the transverse-extended overlapping diaphragm mounts of the support arms 616, 617. The mounting surfaces can optionally project along the width of the rectangular diaphragm 622 to allow the support arms 616, 617 to overlap the mounting surfaces on a portion of the leaf-spring extensions in addition to the transverse-extended overlapping diaphragm mounts. In some examples, the anvil 612 may also include a non-metallic (such as a plastic) component coupled to its top surface (shown as 468 of FIG. 4D). The non-metallic component may act as an interface between the device and a human to couple the vibrations of the anvil to the human.

Furthermore, the two support arms 616, 617 are connected to opposite ends of the diaphragm 622 (via the overlapping diaphragm mounts) so as to balance torque generated on the diaphragm 622 by the individual support arms 616, 617. That is, each of the support arms 616, 617 is connected to the diaphragm 622 away from its center-point, but at opposing locations of the diaphragm 622 so as to balance the resulting torque on the diaphragm 622.

When assembled, the first support arm 616, 617 is connected to the yoke 602 at one end via the first strut 621, and the leaf spring extension 610, 611 is projected adjacent the length of the diaphragm 622. The overlapping diaphragm mount of the first support arm 616, 617 connects to the diaphragm 622 at the mounting surface. One edge of the mounting surface is situated adjacent the second strut 623, but the opposite end can extend along the width of the diaphragm 622 to underlap the overlapping diaphragm mount. Similarly, the second support arm 617 is connected to the yoke 602 at one end via the second strut 623, and the leaf spring extension 611 is projected adjacent the length of the diaphragm 622. The overlapping diaphragm mount of the first support arm connects to the diaphragm 622 at the mounting surface. One edge of the mounting surface is situated adjacent the first strut 621, but the opposite end can extend along the width of the diaphragm 622 to underlap the overlapping diaphragm mount. To allow for movement of the diaphragm 622 via flexion of the leaf spring extensions 610 and 611 of the support arms 616 and 617, each of the support arms 616 and 617 and the diaphragm 622 are free of motion-impeding obstructions with the yoke 602, wire coil 604 and/or permanent magnets 608.

In operation, electrical signals are provided to the BCT 600 that are based on a source of audio content. The BCT 600 is situated in a wearable computing device such that the vibrations of the diaphragm 622 are conveyed to a bony structure of a wearer's head (to provide vibrational propagation to the wearer's inner ear). For example, with reference to FIG. 1, the processor 152 can interpret signals from the audio input device 160 communicating a data indicative of audio content (e.g., a digitized audio stream). The processor 152 can generate electrical signals to the wire coil 604 to create a time-changing magnetic field sufficient to vibrate the diaphragm 622 to create vibrations in the wearer's inner ear corresponding to the original audio content. For example, the electrical signals can drive currents in alternating directions through the wire coil 604 so as to create a time-changing magnetic field with a frequency and/or amplitude sufficient to create the desired vibrations for perception in the inner ear.

The anvil 612 of the diaphragm 622 can optionally include mounting points, such as, for example, threaded holes, to allow for securing an anvil to the BCT 600. For example, an anvil with suitable dimensions and/or shape for coupling to a bone structure of a human head can be mounted to the anvil 612 of the diaphragm 622. The mounting points thereby allow for a single BCT design to be used with multiple different anvils, such as some anvils configured to contact a wearer's temple, and others configured to contact a wearer's mastoid bone, etc. It is noted that other techniques may be used to connect the diaphragm 622 to an anvil, such as adhesives, heat staking, interference fit ("press fit"), insert molding, welding, etc. Such connection techniques can be employed to provide a rigid bond between an anvil and the anvil 612 such that vibrations are readily transferred from the anvil 612 to the anvil and not absorbed in such bonds. In some examples, the diaphragm 622 can be integrally formed with a suitable anvil, such as where a vibrating surface of the diaphragm 622 is exposed to be employed as an anvil for vibrating against a bony portion of the wearer's head.

The diaphragm 622 may also include mounting points for permanent magnets 608 and the post 606. The permanent magnets 608 may be mounted to the diaphragm 622 at each end. The post 606 may be located in approximately the center of the diaphragm 622. Additionally, the post 606 may extend into a center open region of the coil 604. As shown in FIG. 6, the permanent magnets 608 may have a bottom layer of SPCD 624 affixed to them.

In some embodiments, the support arms 616 and 617 are cantilevered along the length of the diaphragm 622 (i.e., along the longest dimension of the approximately rectangular plate forming the anvil 612). One end of the cantilevered support arm is connected to the yoke 602 via the strut 621 near one side of the diaphragm 622, and the opposite end of the support arm is connected to the diaphragm 622 near the opposite end of the diaphragm 622 via the support surface and the overlapping diaphragm mount. Similarly, one end of the cantilevered support arm is connected to the yoke 602 via the strut 623 near one side of the diaphragm 622, and the opposite end of the support arm is connected to the diaphragm 622 near the opposite end of the diaphragm 622 via the support surface and the overlapping diaphragm mount. Thus, the two support arms 616 and 617 cross one another on opposite sides of the diaphragm 622 to balance the torque on the diaphragm 622, with one extending adjacent one side of the diaphragm 622, the other extending along the opposite side of the diaphragm 622.

It is noted that the BCT 600 shows the connection between the support arms 616, 617 and the diaphragm 622 with the support arms 616, 617 overlapping the diaphragm 622 (e.g., at the overlapping diaphragm mounts). However, a secure mechanical connection between the support arms 616, 617 and the diaphragm 622 can also be provided by arranging the diaphragm 622 to overlap the support arms 616, 617. In such case, the support arms 616, 617 can optionally be lowered by an amount approximately equal to the thickness of the diaphragm mounting surfaces to achieve a comparable separation between the lower surface of diaphragm 622 and the electromagnetic coil 604.

Figure 7:
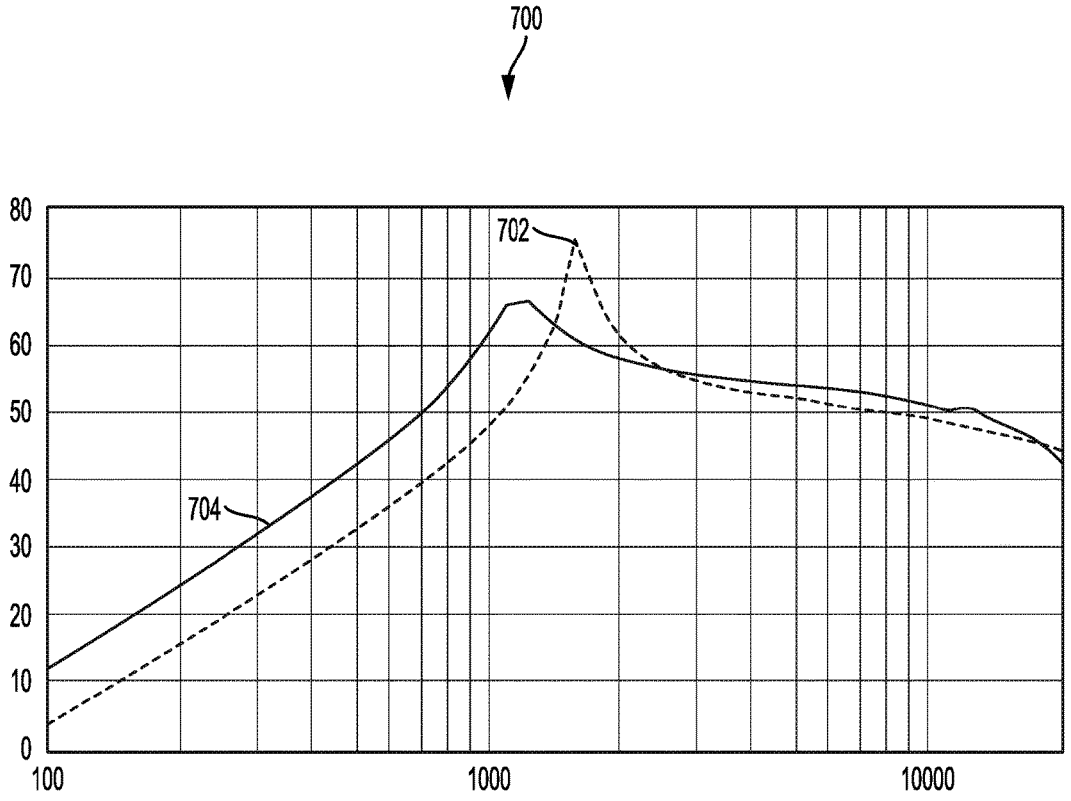
FIG. 7 illustrates an example frequency response curves according to an example embodiment.

FIG. 7 illustrates an example frequency response curves 700 according to an example embodiment. The dotted curve 702 corresponds to a conventionally-constructed BCT device. The solid curve 704 corresponds to a BCT device constructed as described herein. The frequency response curves 700 plot the various frequencies a BCT can play along the horizontal axis (measured in Hz) and the respective BCT output amplitude for a given frequency along the vertical axis (measured in decibels). Thus, as shown in FIG. 7, the output amplitude of a BCT is function of the input frequency.

The presently-disclosed BCT device has a resonant frequency that is lower than the resonant frequency of a conventional BCT device. The change in resonant frequency can be seen by the two different peaks of the curves 700. The conventional BCT has a resonant frequency of about 1800 Hz, as shown by dotted curve 702. The presently-disclosed BCT has a resonant frequency of about 1200 Hz, as shown by solid curve 704. The shift in resonant frequency may be caused, at least in part, by moving the permanent magnets and the post from being mounted on the yoke to being mounted on the diaphragm. By mounting these components on the diaphragm, they become part of the vibrating components of the BCT and increase the vibrating mass. A larger vibrating mass will generally have a lower resonant frequency.

Additionally, as shown by frequency response curves 700, the presently disclosed BCT also has a higher overall sensitivity. When a BCT has higher sensitivity, it may be louder based on using an equivalent power level fed to the BCT. The higher sensitivity may be seen in the frequency response curves 700 as a line being higher in amplitude for a given frequency. The shift in resonant frequency may cause an enhanced low-frequency frequency response, as shown in FIG. 7. For example, the sensitivity of the presently-disclosed BCT is at least 5 decibels higher than the sensitivity for the conventional BCT between frequencies of 100 Hz and about 1500 Hz. Therefore, the presently-disclosed BCT has a low-frequency sensitivity improvement over conventional BCTs. The improved sensitivity may be caused by one of, or the combination of, the lowering of the resonant frequency and from the use of high magnetic permeability materials. The use of high magnetic permeability materials allows the magnetic flux to flow through the BCT device more efficiently, thereby resulting in more efficient BCT operation.

VI. Example Method

Figure 8:
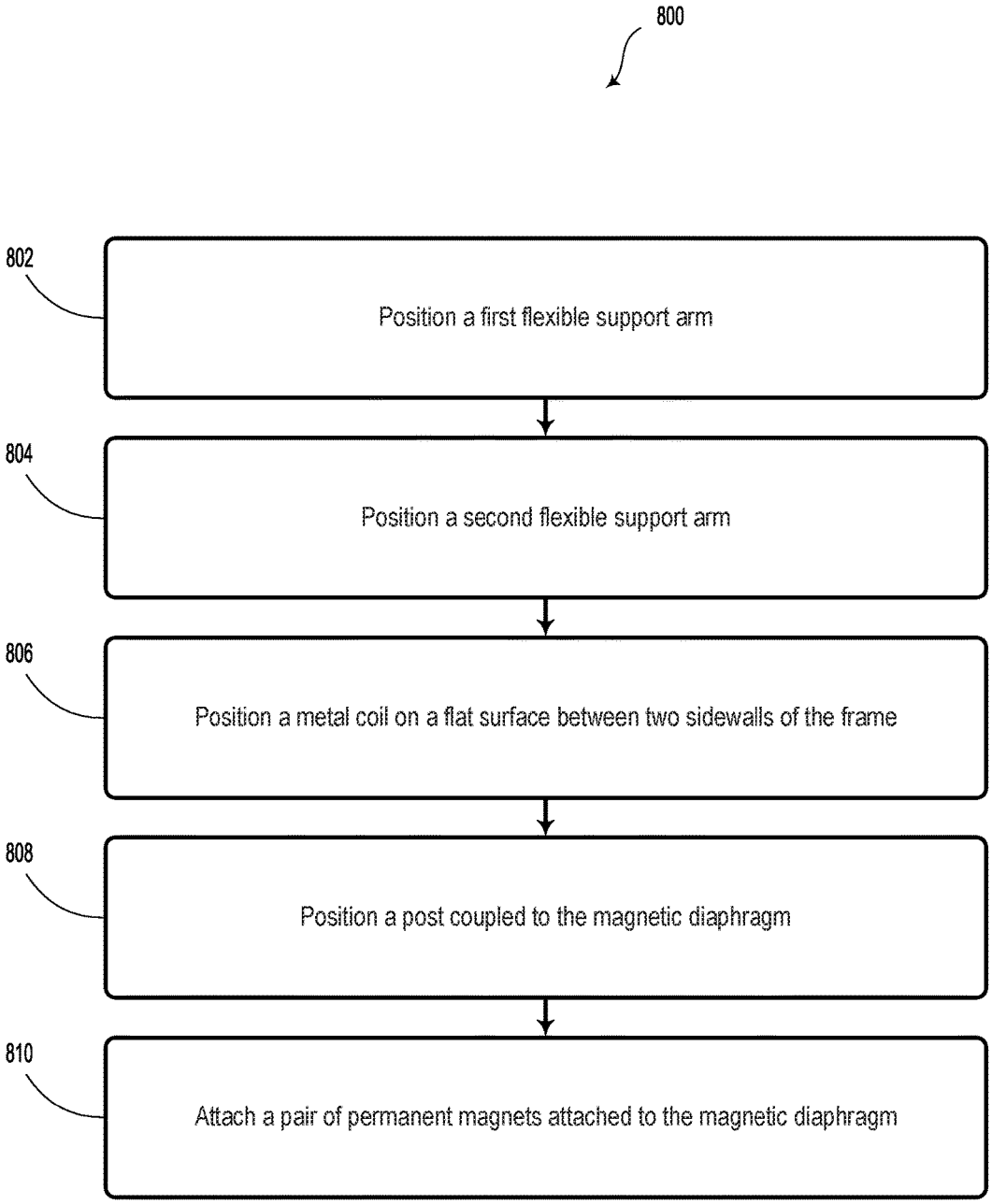
FIG. 8 illustrates a method, according to an example embodiment.

FIG. 8 illustrates a method 800 of assembling a vibration transducer, according to an example embodiment. Method 800 may describe elements and/or operating modes similar or identical to those illustrated and described in reference to FIGS. 1, 2, 3, 4A-D, 5, 6, and 7. While FIG. 8 illustrates a certain steps or blocks, it is understood that other steps or blocks are possible. Specifically, blocks or steps may be added or subtracted. Additionally or alternatively, blocks or steps may be repeated, interchanged, and/or carried out in a different order than illustrated herein.

Block 802 includes positioning a first flexible support arm, having a first end and a second end, such that the first end is positioned over a first mounting surface of a magnetic diaphragm and the second end is positioned over a sidewall of a frame of the vibration transducer. Overlapping regions of the first and second ends of the first flexible support arm overlap the first mounting surface of the magnetic diaphragm and the first sidewall of the frame, respectively.

Block 804 includes positioning a second flexible support arm, having a first end and a second end, such that the first end is positioned over a second mounting surface of the magnetic diaphragm, wherein the second mounting surface and the first mounting surface are on opposing sides of the magnetic diaphragm and the second end is positioned over a sidewall of the frame. Overlapping regions of the first and second ends of the second flexible support arm overlap the second mounting surface of the magnetic diaphragm and the sidewall of the frame, respectively.

Block 806 includes positioning a metal coil on a flat surface between the two sidewalls of the frame. Block 808 includes positioning a post on the magnetic diaphragm. The post is configured to extend into a center portion of the metal coil. And, block 810 includes attaching a pair of permanent magnets attached to the magnetic diaphragm. The permanent magnets each flank the post and each permanent magnet has a layer of high permeability steel on a bottom portion.

VII. Conclusion

The particular arrangements illustrated in the Figures should not be viewed as limiting. It should be understood that other embodiments may include more or less of each element illustrated in a given Figure. Further, some of the illustrated elements may be combined or omitted. Yet further, an illustrative embodiment may include elements that are not illustrated in the Figures.

It should be understood that any examples described with reference to a "wearable audio device" may apply equally to audio devices that are not configured to be wearable, so long as such audio devices can be communicatively coupled (e.g., tethered) to another computing device.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A bone conduction transducer comprising:

a yoke comprising a pair of arms wherein a first arm is located at a first end of the yoke and a second arm is located at a second end of the yoke;

a metal coil located between the pair of arms;

a pair of springs each comprising a first end and second end, wherein the first end of each spring is attached to a respective one of the arms of the yoke;

a diaphragm coupled to the second end of each spring, wherein the diaphragm is configured to vibrate in response to a signal supplied to the metal coil;

a metallic post that extends into a center portion of the metal coil, wherein the metallic post comprises a high permeability steel, wherein the metallic post is coupled to the diaphragm; and a pair of permanent magnets coupled to the diaphragm on opposite sides of the metallic post.

2. The bone conduction transducer of claim 1, further comprising a layer of a high of permeability steel disposed on at least one surface of the pair of permanent magnets.

3. The bone conduction transducer of claim 1, further comprising a layer of a high permeability steel disposed on a surface of the yoke.

4. The bone conduction transducer of claim 1, further comprising an anvil coupled to the diaphragm, wherein the anvil comprises a high permeability steel.

5. The bone conduction transducer of claim 4, wherein the anvil is coupled to the diaphragm such that the diaphragm is between the metallic post and the anvil.

6. The bone conduction transducer of claim 5, wherein the diaphragm, the anvil, and the metallic post are different portions of a single piece of high permeability steel.

7. The bone conduction transducer of claim 4, further comprising a vibration coupling interface coupled to a surface of the anvil opposite the diaphragm, wherein the vibration coupling interface comprises a polymer.

8. A wearable computing system comprising:

a support, wherein one or more portions of the support are configured to contact a wearer;

an audio interface for receiving an audio signal; and a vibration transducer including:

a yoke comprising a pair of arms wherein a first arm is located at a first end of the yoke and a second arm is located at a second end of the yoke;

a metal coil located between the pair of arms;

a pair of springs each comprising a first end and second end, wherein the first end of each spring is attached to a respective one of the arms of the yoke;

a diaphragm coupled to the second end of each spring, wherein the diaphragm is configured to vibrate in response to a signal supplied to the metal coil;

an anvil coupled to the diaphragm;

a metallic post that extends into a center portion of the metal coil, wherein the metallic post comprises a high permeability steel, wherein the metallic post is coupled to the diaphragm; and a pair of permanent magnets coupled to the diaphragm, wherein permanent magnets of the pair of permanent magnets are located on opposite sides of the metallic post, and wherein each permanent magnet has a surface opposite the diaphragm with a layer of high permeability steel thereon.

9. The wearable computing system of claim 8, further comprising a vibration coupling interface coupled to a surface of the anvil opposite the diaphragm.

10. The wearable computing system of claim 9, wherein the vibration coupling interface comprises a polymer.

11. The wearable computing system of claim 8, further comprising a layer of high permeability steel disposed on a surface of the yoke.

12. The wearable computing system of claim 11, wherein the metal coil is disposed on the layer of high permeability steel disposed on the yoke.

13. The wearable computing system of claim 8, wherein the diaphragm, the anvil, and the metallic post are different portions of a single piece of high permeability steel.

14. A method of assembling a vibration transducer comprising:

positioning a first flexible support arm, having a first end and a second end, relative to a magnetic diaphragm and a frame, such that the first end is positioned over a first mounting surface of the magnetic diaphragm and the second end is positioned over a first sidewall of the frame, wherein overlapping regions of the first and second ends of the first flexible support arm overlap the first mounting surface of the magnetic diaphragm and the first sidewall of the frame, respectively;

positioning a second flexible support arm, having a first end and a second end, relative to the magnetic diaphragm and the frame, such that the first end is positioned over a second mounting surface of the magnetic diaphragm and the second end is positioned over a second sidewall of the frame, wherein overlapping regions of the first and second ends of the second flexible support arm overlap the second mounting surface of the magnetic diaphragm and the second sidewall of the frame, respectively;

positioning a metal coil between the first and second sidewalls of the frame;

positioning a post coupled to the magnetic diaphragm, such that the post extends into a center portion of the metal coil; and attaching a pair of permanent magnets to the magnetic diaphragm, such that permanent magnets of the pair of permanent magnets are on opposite sides of the post, wherein each permanent magnet has a surface opposite the magnetic diaphragm with a layer of high permeability steel thereon.

15. The method of claim 14, wherein the frame includes a flat surface between the first and second sidewalls, further comprising providing a layer of high permeability steel on the flat surface of the frame.

16. The method of claim 14, further comprising coupling an anvil to the magnetic diaphragm.

17. The method of claim 16, wherein the post and the anvil are coupled to the magnetic diaphragm before the first and second flexible support arms are coupled to the first and second sidewalls of the frame.

18. The method of claim 16, wherein the post, the anvil, and the magnetic diaphragm comprise a high permeability steel.

* * * * *